United States Patent [19]

Yamaguchi

[11] Patent Number: 4,629,249

[45] Date of Patent: Dec. 16, 1986

[54] DEVICE FOR A RECLINING CHAIR

[75] Inventor: Tomoshige Yamaguchi, Yokohama, Japan

[73] Assignee: Okamura Corporation, Yokohama, Japan

[21] Appl. No.: 691,073

[22] Filed: Jan. 14, 1985

[30] Foreign Application Priority Data

Jan. 18, 1984 [JP] Japan ..... 59-4211[U]

[51] Int. Cl.[4] ..... A47C 1/032

[52] U.S. Cl. ..... 297/300; 297/301; 297/316; 297/319

[58] Field of Search ..... 297/300, 301, 316, 319, 297/320, 340, 343

[56] References Cited

U.S. PATENT DOCUMENTS

| | | | |
|---|---|---|---|
| 1,846,797 | 2/1932 | Decker | 297/319 |
| 2,321,385 | 6/1943 | Herold | 297/301 |
| 2,471,024 | 5/1949 | Cramer | 297/319 |
| 2,859,799 | 11/1958 | Moore | 297/301 |
| 3,356,414 | 12/1967 | Doerner | 297/301 |

FOREIGN PATENT DOCUMENTS

| | | | |
|---|---|---|---|
| 1099705 | 2/1961 | Fed. Rep. of Germany | 297/316 |
| 1164434 | 10/1958 | France | 297/319 |

*Primary Examiner*—William E. Lyddane
*Assistant Examiner*—Peter R. Brown
*Attorney, Agent, or Firm*—Poms, Smith, Lande & Rose

[57] ABSTRACT

A device for a reclining chair, in which tilting angle of a back of the chair in relation to a seat panel can be adjusted to a suitable position according to requirements and/or choice by expanding and/or contracting operations of a gas-filled spring, when working or studying with the back at substantially upstanding position, the back and the seat panel cooperate together to support a human body in stable, while with the back inclined largely backwards for resting, the seat panel is tilted a little as well as its front edge being raised, so that comfortable sitting postures can be provided at any tilting angle of the back.

7 Claims, 5 Drawing Figures

DEVICE FOR A RECLINING CHAIR

BACKGROUND OF THE INVENTION

1. Field of the Invention

This invention relates to a reclining chair apparatus, particularly to a chair which is adapted for inclining and/or returning its seat and back portions in cooperation with each other to positions of inclination at corresponding suitable angles for working or relaxing.

2. Description of the Prior Art

There has been used a reclining chair in which at least its back, or its back and seat simultaneously can be inclined so as to take a suitable position for conditions in use.

The former type of the reclining chair in the prior art, inclining the back when seated causes friction between the person being seated and the chair, and/or makes him feel uncomfortable by losing balance.

In the latter type of the reclining chair, the seat and the back are designed to incline together in a single unit about a fulcrum at the center of the seat, so that by inclining the back fully backward for resting, the front edge of the seat is raised upwardly and the foot of the person is lifted from the floor which provides quite uncomfortable feeling to him.

There has been disclosed an improved reclining chair in the Japanese Patent Application Publication No. 58-127617, in which, in order to overcome the aforesaid drawbacks, the back and seat are designed to incline about a fulcrum located at a front end of the seat instead of its center, so that when the back is inclined to backwards, the back together with the rear portion of the seat is lowered to prevent the foot being lifted from the floor. However, the reclining chair of this type still have a fault that the angle of the back in relation to the seat is fixed to a predetermined degree and would not be changed at any positions the back is inclined.

SUMMARY OF THE INVENTION

In general, it is rather better to extend the body by increasing angle of the seat in relation to the seat than at working positions in order to have a good rest.

Therefore, the object of the present invention is to provide a reclining chair which is essentially adapted for satisfying the above-mentioned natural requirements of human body.

In order to achieve the above objective, the device for a reclining chair according to the present invention comprises a base frame being fixedly mounted at its front on the upper end part of a chair leg shaft, and extends backwards therefrom, in which guiding apertures or slots are formed through on each rear end portion of both side panels, said apertures first extending slightly upwards to the backwards for a length at a small angle to the horizontal and then turning further upwards at a larger angle; a seat frame which is pivotally mounted in its middle to the front portion of the base frame by a pivot shaft so as to rotate about the pivot shaft; a back frame which is pivotally mounted at its upper front end to the upper rear end of the seat frame by another pivot shaft so as to rotate about said another pivot shaft, and is provided with a sliding shaft transversely mounted at the lower front part of the back frame, and being inserted within and through the guiding apertures of the base frame; and a gas-filled spring being operational for opening and closing, a front end of which is pivotally attached to the front part of the seat frame by a third pivot shaft so as to rotate about the pivot shaft, and a rear end of which is pivotally connected to the sliding shaft.

The device for a reclining chair of the present invention is so constructed as described in the above, when the back is set at an almost upright position during working or studying, while the angle of the back in relation to the seat may be maintained in a suitable range of relatively small degrees for such conditions, the back and seat may swing in cooperation according to each physical constitution and/or choice of the user to provide good stable support to the user's back. When the back is tilted largely backwards more than a certain extent for resting, while the rear side of the seat may be slightly lowered in combination with the said movement of the back, the angle of the back in relation to the seat may be increased sufficiently, so that the user can take a good rest, and furthermore, the front end of the seat may be raised very slightly from the working position, so that good comfortable feelings may be provided at any position without lifting his foot from the floor.

BRIEF DESCRIPTION OF THE DRAWINGS

With reference to the accompanying drawings, the preferred embodiment of the present invention is described in details hereinafter for better understanding of the invention.

DESCRIPTION OF THE PREFERRED EMBODIMENT

Figure 1:
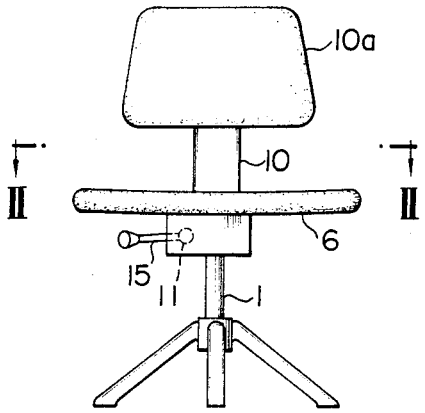
FIG. 1 is a schematic front view of a reclining chair using the device according to the invention.
Figure 2:
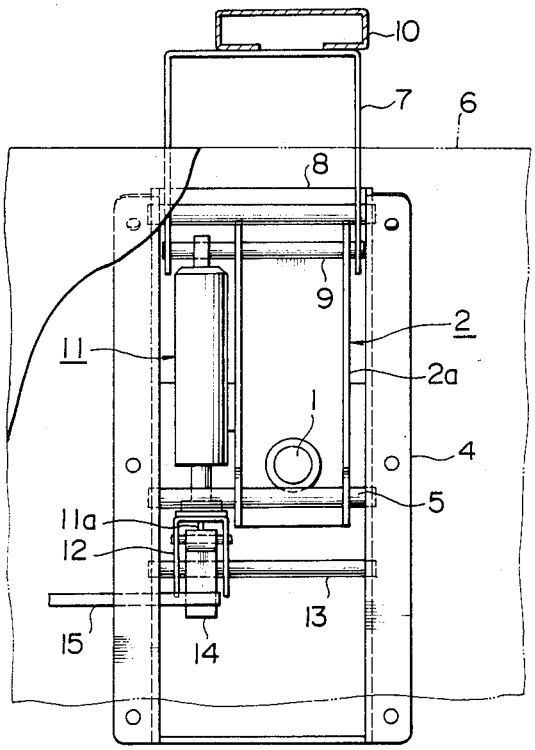
FIG. 2 is a plan view of the device for a reclining chair where the seat panel is removed from the chair in FIG. 1.

Referring to the accompanying drawings, a base frame 2 which has an U-shaped vertical cross-section in longitudinal direction is fixedly mounted on the upper end of the shaft 1 of the chair leg and extends backwards therefrom. As seen on the upper part in FIG. 2 and on the right in FIG. 3, guide apertures 3 are formed through on the rear parts of both side panels **2*a*** of the base frame, first running straight slightly upwardly backwards for a certain length and then turned and directed further upwards.

The seat frame 4 is pivotally mounted to the base frame 2 at the front upper part by a first transversely extending pivot shaft 5 located in the center of the seat frame, and is also provided with a seat panel 6 fixedly mounted on the upper surface of the frame.

Also, the seat frame 4 is provided with the back frame 7 having a substantially U-shaped upper end, in which a front upper part of the back frame is pivotally mounted to the rear upper part of the seat frame 4 by a second transversely extending pivot shaft 8.

A sliding shaft 9 transversely mounted at the front lower part of the back frame 7 is passed through the guiding apertures 3 of the base frame 2, and a back 10 is fixedly mounted onto the rear side of the back frame 7 and extends upwards therefrom.

A gas-filled spring 11 is pivoted at the front end to the front part of the seat frame 4 through a metal attachment 12 by a fourth transversely extending pivot shaft 13, and is also pivoted at the rear end to the sliding shaft 9.

A valve opening plug 11*a* of the gas-filled spring can be operated through a press member 14 pivotally mounted to the metal attachment 12 by a lever 15 passing through both side panels of the seat frame 4.

Figure 3:
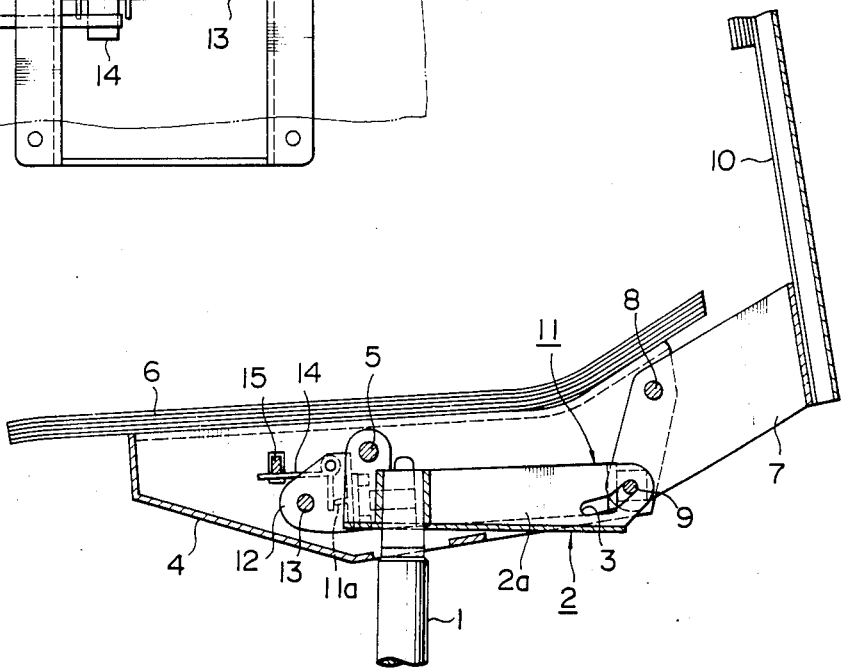
FIG. 3 is a longitudinal cross-sectional view of the device in FIG. 2 when the back is slightly tilted forwards.

FIG. 3 illustrates the reclining chair when a person being seated is bending a little forward, in which while both the seat panel 6 and the back 10 are slightly bending forward, the sliding shaft is positioned at the rear ends of the guiding apertures 3.

Figure 4:
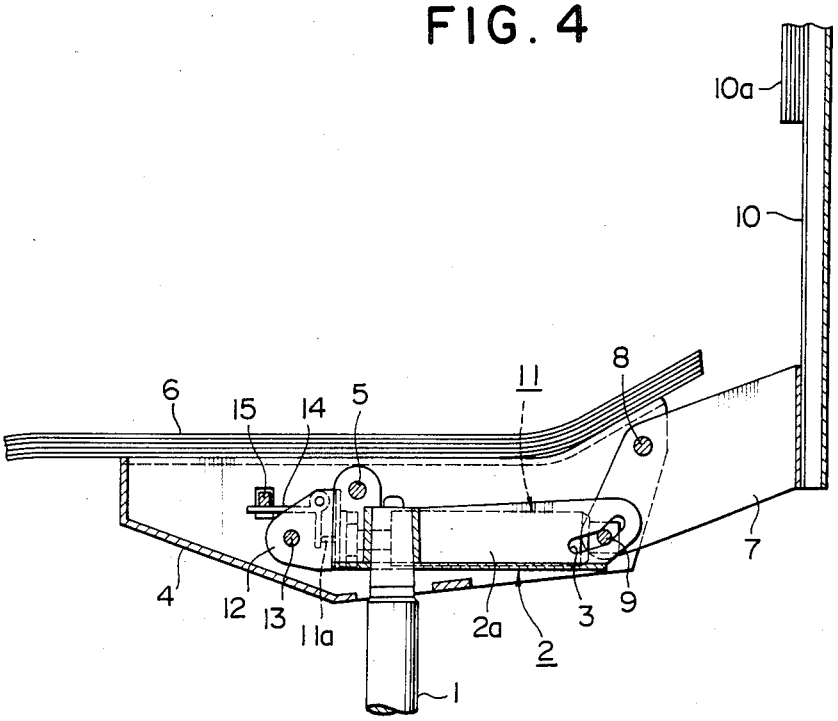
FIG. 4 is a the same view with FIG. 3 when the back is set at the upright position.

FIG. 4 illustrates the reclining chair when the person is seated with his upper part of the body upstanding, in which while the seat panel is set substantially horizontal and the back 10 is in an upstanding position, the sliding shaft 9 is now positioned in the middle in the guiding apertures 3, following swinging of the back frame 7 around the second pivot shaft 8.

Since the rear parts of the guiding apertures 3 have a steep ascent between these two positions described above, when the back 10 is tilted backwards, the seat panel 6 follows the movement and also is tilted backwards, in which the angle between these both members may not be varied largely but slightly increased, the person can be supported in a suitable sitting posture for working at each angle position of tilting backwards, and further, the backwardly tilting angle can be adjusted by operating the lever 15 to properly extend and/or contract the gas-filled spring 11 in accordance with physical constitution and/or choice of the user, or sort of the working.

Figure 5:
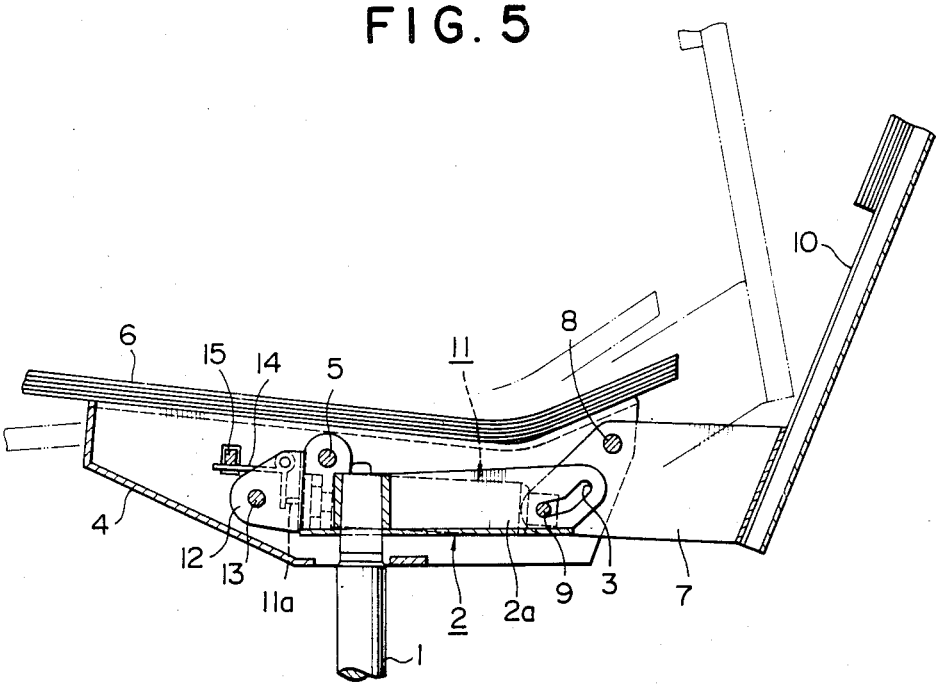
FIG. 5 is also the same view with FIG. 3 when the back is tilted backwards.

In this condition, the gas-filled spring 11 can be contracted to tilt the back 10 largely backwards, as shown in FIG. 5, for taking a rest, in which the sliding shaft 9 is moved forward within the guiding apertures 3.

Because the front parts of the guiding apertures 3 are gently sloped, the seat panel 6 may be inclined a little backward even when the sliding shaft 9 is moved to the front end within the aperture, the angle of the back 10 in relation to the seat panel 6 may be increased largely, and in addition, the front edge of the seat panel 6 rises so slightly that the person's foot would not be lifted from the floor, providing a suitable and stable posture to be taken for resting.

In the above described embodiment, the guiding apertures 3 ascend in two steps in the upwardly backward direction, and it is also preferable to vary the ascending aperture in three steps or more, or the aperture may be curved in arcuate form to change the tilting angle successively.

I claim:

1. A device for a reclining chair, comprising:

a base frame having two side panels being fixedly mounted at its front on the upper end part of a chair leg shaft, and extends backwards therefrom, in which guiding apertures are formed through on each rear end portion of both side panels, said apertures ascending upwards to the rear;

a seat frame which is pivotally mounted in its middle to the front portion of the base frame by a pivot shaft so as to rotate about the pivot shaft;

a back rest frame having front and rear ends and upper and lower portions, said back rest frame being pivotally mounted at its upper front end to the upper rear end of the seat frame by another pivot shaft so as to rotate about said another pivot shaft, and is provided with a sliding shaft transversely mounted at the lower front part of the back frame, and being inserted within and through the guiding apertures of the base frame; and a gas-filled spring being operational for opening and closing, a front end of which is pivotally attached to the front part of the seat frame by a third pivot shaft so as to rotate about the pivot shaft, and a rear end of which is pivotally connected to the sliding shaft;

whereby when the seat is tilted back, the sliding shaft moves forward and down in said guiding apertures, and the back rest frame tilts back through a substantially greater angle than said seat to provide a comfortable resting position for the user; and whereby said gas spring intercouples said sliding shaft and said base frame to resiliently bias said seat and seat back to the desired angular orientation.

2. A device as claimed in claim 1, wherein said apertures first extend slightly upwards to the rear for a length at a small angle to the horizontal and then turn further upwards at a larger angle.

3. A device as claimed in claim 1, wherein said apertures are ascending successively with increasing angles to the horizontal in the backward direction.

4. A device as claimed in claim 1, wherein said apertures are ascending progressively with an increasing angle to the horizontal toward the rear of the chair.

5. A device for a reclining chair, comprising:

a base frame being fixedly mounted at its front on the upper end part of a chair leg shaft, and extending backwards therefrom, said frame having side panels, in which guiding apertures are formed through on each rear end portion of both side panels, said apertures ascending upwards to the rear of said chair;

a seat frame pivotally mounted in its middle to the front portion of the base frame by a pivot shaft so as to rotate about the pivot shaft;

a back rest frame having front and rear ends and upper and lower portions, said back rest frame being pivotally mounted at its upper front end to the upper rear end of the seat frame by another pivot shaft so as to rotate about said pivot shaft, and is provided with a sliding shaft transversely mounted at the lower front part of the back frame, and being inserted within and through the guiding apertures of the base frame;

a gas filled spring or air cylinder being operational for opening and closing, a front end of which is pivotally attached to the front part of the seat frame by a third pivot shaft so as to rotate about the pivot shaft, and a rear end of which is pivotally connected to the sliding shaft;

said apertures first extending slightly upward to the rear for a distance at a small angle to the horizontal, and then turning further upward at a larger angle to the horizontal;

whereby when the seat is tilted back, the sliding shaft moves forward and down in said guiding apertures, and the back rest frame tilts back through a substantially greater angle than said seat to provide a comfortable resting position for the user; and whereby said gas spring intercouples said sliding shaft and said base frame to resiliently bias said seat and seat back to the desired angular orientation.

6. A device as claimed in claim 5, wherein said apertures are ascending in successive steps with increasing angles to the horizontal in the backward direction.

7. A device for a reclining chair, comprising:

a base frame being fixedly mounted at its front on the upper end part of a chair leg shaft, and extending backwards therefrom, said frame having side panels, in which guiding apertures are formed through on each rear end portion of both side panels, said apertures ascending upwards to the rear of said chair;

a seat frame pivotally mounted in its middle to the front portion of the base frame by a pivot shaft so as to rotate about the pivot shaft;

a back rest frame having front and rear ends and upper and lower portions, said back rest frame being pivotally mounted at its upper front end to the upper rear end of the seat frame by another pivot shaft so as to rotate about said pivot shaft, and is provided with a sliding shaft transversely mounted at the lower front part of the back frame, and being inserted within and through the guiding apertures of the base frame;

a gas-filled spring or air cylinder being operational for opening and closing, a front end of which is pivotally attached to the front part of the seat frame by a third pivot shaft so as to rotate about the pivot shaft, and a rear end of which is pivotally connected to the sliding shaft;

means for opening a valve included in said gas filled spring or air cylinder to permit readjustment thereof; and said apertures first extending slightly upward to the rear for a distance at a small angle to the horizontal, and then turning further upward at a larger angle to the horizontal;

whereby when the seat is tilted back, the sliding shaft moves forward and down in said guiding apertures, and the back rest frame tilts back through a substantially greater angle than said seat to provide a comfortable resting position for the user; and whereby said gas spring intercouples said sliding shaft and said base frame to resiliently bias said seat and seat back to the desired angular orientation.

* * * * *